US011781454B2

(12) United States Patent
Ikegami et al.

(10) Patent No.: US 11,781,454 B2
(45) Date of Patent: Oct. 10, 2023

(54) INTERNAL COMBUSTION ENGINE

(71) Applicant: TOYOTA JIDOSHA KABUSHIKI KAISHA, Aichi-ken (JP)

(72) Inventors: Hiroaki Ikegami, Toyota (JP); Yukihiro Nishio, Kasugai (JP); Kazuyuki Owaki, Nagoya (JP); Takeshi Miura, Nisshin (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 18/177,075

(22) Filed: Mar. 1, 2023

(65) Prior Publication Data

US 2023/0279793 A1 Sep. 7, 2023

(30) Foreign Application Priority Data

Mar. 7, 2022 (JP) ..... 2022-034341

(51) Int. Cl.

| | |
|---|---|
| ***F01M 11/02*** | (2006.01) |
| ***F02B 75/20*** | (2006.01) |
| ***F01M 11/00*** | (2006.01) |
| ***F01M 13/04*** | (2006.01) |
| ***F01M 13/00*** | (2006.01) |
| ***F02B 75/18*** | (2006.01) |

(52) U.S. Cl.

CPC ..... *F01M 11/02* (2013.01); *F01M 11/0004* (2013.01); *F01M 13/04* (2013.01); *F02B 75/20* (2013.01); *F01M 2013/0038* (2013.01); *F02B 2075/1816* (2013.01)

(58) Field of Classification Search

CPC .... F01M 11/02; F01M 11/0004; F01M 13/04; F01M 2013/0038; F02B 75/20; F02B 2075/1816

See application file for complete search history.

(56) References Cited

U.S. PATENT DOCUMENTS

2018/0223708 A1* 8/2018 Kawai ..... F02D 21/08

FOREIGN PATENT DOCUMENTS

| | | | |
|---|---|---|---|
| JP | 2010180834 A | | 8/2010 |
| JP | 2015028331 A | | 2/2015 |
| JP | 2020067005 A | * | 4/2020 |
| JP | 2020067005 A | | 4/2020 |

OTHER PUBLICATIONS

Machine Translation of JP-2020067005-A PDF File Name: "JP2020067005A_Machine_Translation.pdf".*

* cited by examiner

*Primary Examiner* — Jacob M Amick
*Assistant Examiner* — Ruben Picon-Feliciano
(74) *Attorney, Agent, or Firm* — HAUPTMAN HAM, LLP

(57) ABSTRACT

An internal combustion engine includes a first blow-by gas passage defined in a second wall. The internal combustion engine includes a second blow-by gas passage defined in a third wall. The internal combustion engine includes a third blow-by gas passage defined in a fourth wall. The first blow-by gas passage to the third blow-by gas passage connect an oil chamber and an oil separator to each other. The second wall includes a first connecting path. The fourth wall includes a second connecting path. The first connecting path connects the first crank chamber and the second crank chamber. The second connecting path connects the third crank chamber and the fourth crank chamber to each other. The third wall does not have a passage connecting the second crank chamber and the third crank chamber to each other.

10 Claims, 3 Drawing Sheets

INTERNAL COMBUSTION ENGINE

RELATED APPLICATIONS

The present application claims priority of Japanese Patent Application No. 2022-034341 filed Mar. 7, 2022, the disclosure of which is hereby incorporated by reference herein in its entirety.

BACKGROUND

1. Field

The present disclosure relates to an internal combustion engine.

2. Description of Related Art

An internal combustion engine disclosed in Japanese Laid-Open Patent Publication No. 2020-067005 includes a crankshaft and four pistons. The internal combustion engine includes four cylinders, four crank chambers, and an oil chamber. Each cylinder accommodates a piston. The four cylinders are arranged along the axis of the crankshaft. The crank chamber is a space for the crankshaft to rotate. Each of the four crank chambers is connected to each corresponding cylinder. The oil chamber is a space for storing oil. The oil chamber is connected to four crank chambers on a side opposite to each cylinder. The internal combustion engine defines three connecting paths. Each of the connecting paths connects adjacent crank chambers to each other.

An internal combustion engine as disclosed in Japanese Laid-Open Patent Publication No. 2020-067005 includes a plurality of blow-by gas passages. The blow-by gas passage is a passage for guiding the gas in the oil chamber to the oil separator. In such an internal combustion engine, an air flow is generated in the crank chamber and the oil chamber as each piston reciprocates. If an unexpected turbulent flow occurs in the air flow in the crank chamber and the oil chamber, an excessive amount of oil may flow into the oil separator, or the oil may not be appropriately separated in the oil separator.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an internal combustion engine includes a first cylinder, a second cylinder, a third cylinder, and a fourth cylinder which are cylinders arranged in order in a first direction along an axis of a crankshaft. The internal combustion engine also includes a first crank chamber connected to the first cylinder, a second crank chamber connected to the second cylinder, a third crank chamber connected to the third cylinder, and a fourth crank chamber connected to the fourth cylinder. The internal combustion engine also includes an oil chamber that is connected to the first crank chamber, the second crank chamber, the third crank chamber, and the fourth crank chamber on a side opposite to the cylinders, the oil chamber storing oil. The internal combustion engine also includes a first piston reciprocating in the first cylinder, a second piston reciprocating in an opposite phase to the first piston in the second cylinder, a third piston reciprocating in an opposite phase to the first piston in the third cylinder, and a fourth piston reciprocating in a same phase as the first piston in the fourth cylinder. The internal combustion engine further includes a first wall that defines the first crank chamber from a side in a second direction opposite to the first direction, a second wall that separates the first crank chamber and the second crank chamber from each other, a third wall that separates the second crank chamber and the third crank chamber from each other, a fourth wall that separates the third crank chamber and the fourth crank chamber from each other, and a fifth wall that defines the fourth crank chamber from a side in the first direction. The internal combustion engine also includes a first blow-by gas passage defined in the second wall and connecting the oil chamber and an oil separator, a second blow-by gas passage defined in the third wall and connecting the oil chamber and the oil separator, and a third blow-by gas passage defined in the fourth wall and connecting the oil chamber and the oil separator. The internal combustion engine also includes a first connecting path defined in the second wall and connecting the first crank chamber and the second crank chamber to each other, and a second connecting path defined in the fourth wall and connecting the third crank chamber and the fourth crank chamber to each other. The third wall has no passage connecting the second crank chamber and the third crank chamber to each other.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

<Schematic Configuration of Internal Combustion Engine>

Hereinafter, an embodiment of the present disclosure will be described with reference to FIGS. 1 to 3. First, a schematic configuration of an internal combustion engine 100 will be described. In the following description, front and back, left and right, and up and down directions refer to directions viewed from a driver seated on a driver's seat of a vehicle in a state where the internal combustion engine 100 is mounted on the vehicle.

Figure 1:
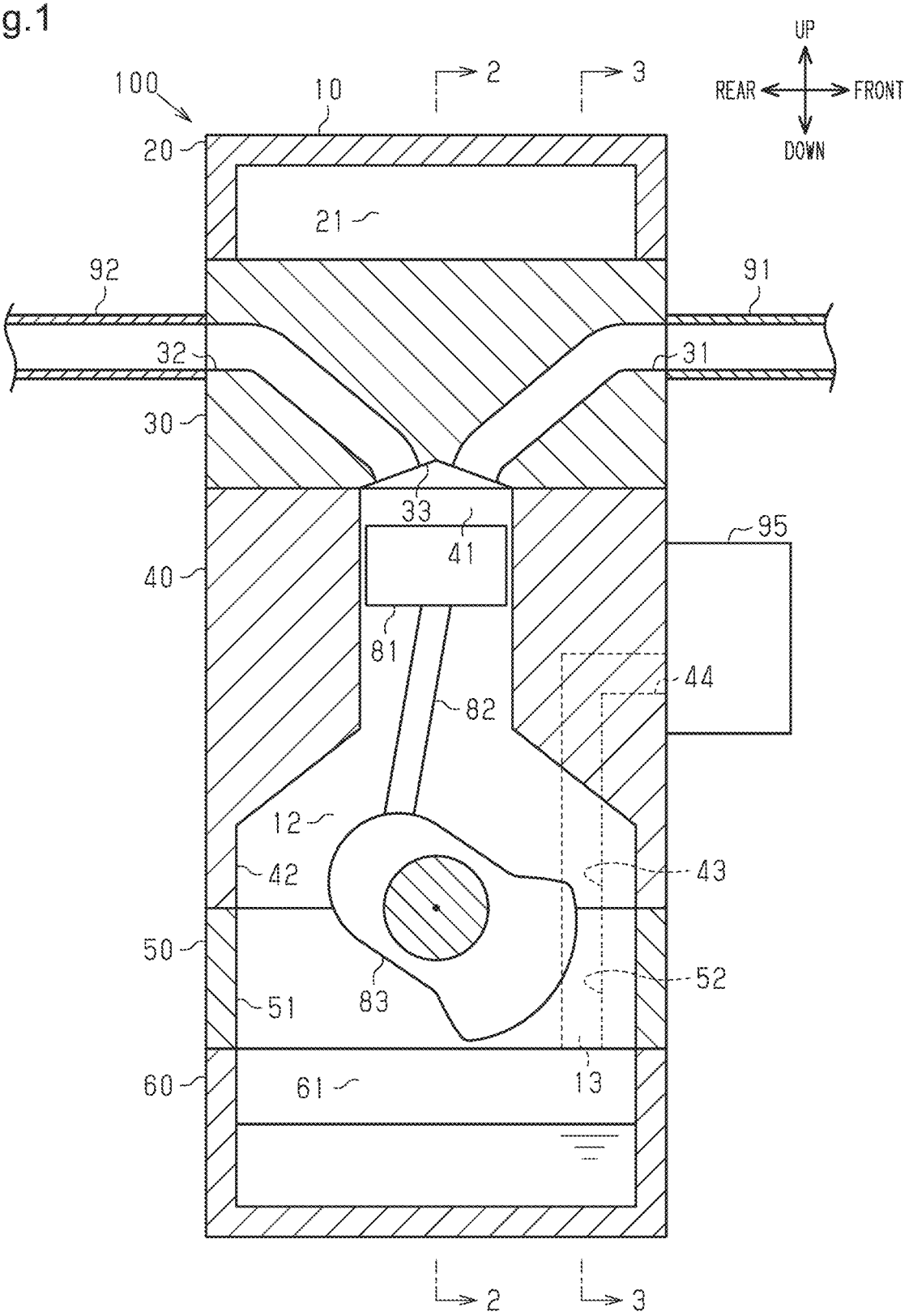
FIG. 1 is a cross-sectional view of an internal combustion engine.

As illustrated in FIG. 1, the internal combustion engine 100 includes an engine body 10, a plurality of pistons 81, a plurality of connecting rods 82, a crankshaft 83, an intake pipe 91, and an exhaust pipe 92. The engine body 10 includes a head cover 20, a cylinder head 30, a cylinder block 40, a crankcase 50, and an oil pan 60.

The shape of the cylinder block 40 is a quadrangular prism shape as a whole. The cylinder block 40 includes four cylinders 41 as internal spaces. The cylinder 41 has a substantially circular column shape. The cylinder 41 extends from the upper end of the cylinder block 40 to the vicinity of the vertical center of the cylinder block 40. The cylinder 41 is a space for combusting an air-fuel mixture of fuel and intake air. As illustrated in FIG. 2, the four cylinders 41 are arranged in a line along the axis of the crankshaft 83. In the present embodiment, the internal combustion engine 100 is a so-called in-line four-cylinder engine. Furthermore, the crankshaft 83 extends to the left and right of the vehicle. In the present embodiment, the internal combustion engine 100 is a so-called horizontal engine. Hereinafter, when collectively describing the four cylinders 41, they are simply referred to as the cylinders 41. When describing the four cylinders 41 in a distinguished manner, they are referred to as a first cylinder 41A, a second cylinder 41B, a third cylinder 41C, and a fourth cylinder 41D in order from the right end toward the left direction.

As illustrated in FIG. 1, the piston 81 is located inside the cylinder 41. The piston 81 is coupled to the crankshaft 83 by way of the connecting rod 82. The piston 81 reciprocates in the cylinder 41 by combustion of an air-fuel mixture of fuel and intake air in the cylinder 41. Then, the crankshaft 83 rotates by the reciprocating motion of the piston 81. The internal combustion engine 100 includes four pistons 81 and four connecting rods 82 corresponding to the four cylinders 41. Hereinafter, when collectively describing the four pistons 81, they are simply referred to as the pistons 81. When describing the four pistons 81 in a distinguished manner, they are referred to as a first piston 81A, a second piston 81B, a third piston 81C, and a fourth piston 81D in order from the right end toward the left direction.

In the present embodiment, the internal combustion engine 100 reaches the combustion stroke in the order of the first cylinder 41A, the third cylinder 41C, the fourth cylinder 41D, and the second cylinder 41B. Each cylinder 41 repeats an intake stroke, a compression stroke, a combustion stroke, and an exhaust stroke each time the crankshaft 83 makes two rotations. Therefore, when the first cylinder 41A reaches the combustion stroke, the third cylinder 41C reaches the compression stroke, the fourth cylinder 41D reaches the intake stroke, and the second cylinder 41B reaches the exhaust stroke. In other words, the second piston 81B and the third piston 81C reciprocate in a phase opposite to that of the first piston 81A. The fourth piston 81D reciprocates in the same phase as the first piston 81A.

The cylinder block 40 includes four upper spaces 42 as internal spaces. The upper space 42 is connected to the lower end of the cylinder 41. The upper space 42 extends from the lower end of the cylinder 41 to the lower end of the cylinder block 40. The dimension of the upper space 42 in the longitudinal direction of the vehicle is larger than the dimension of the cylinder 41 in the longitudinal direction of the vehicle. The dimension of the upper space 42 in the lateral direction of the vehicle is smaller than the dimension of the cylinder 41 in the lateral direction of the vehicle. Hereinafter, when collectively describing the four upper spaces 42, they are simply referred to as the upper spaces 42. When describing the four upper spaces 42 in a distinguished manner, they are referred to as a first upper space 42A, a second upper space 42B, a third upper space 42C, and a fourth upper space 42D in order from the right end toward the left direction.

Figure 2:
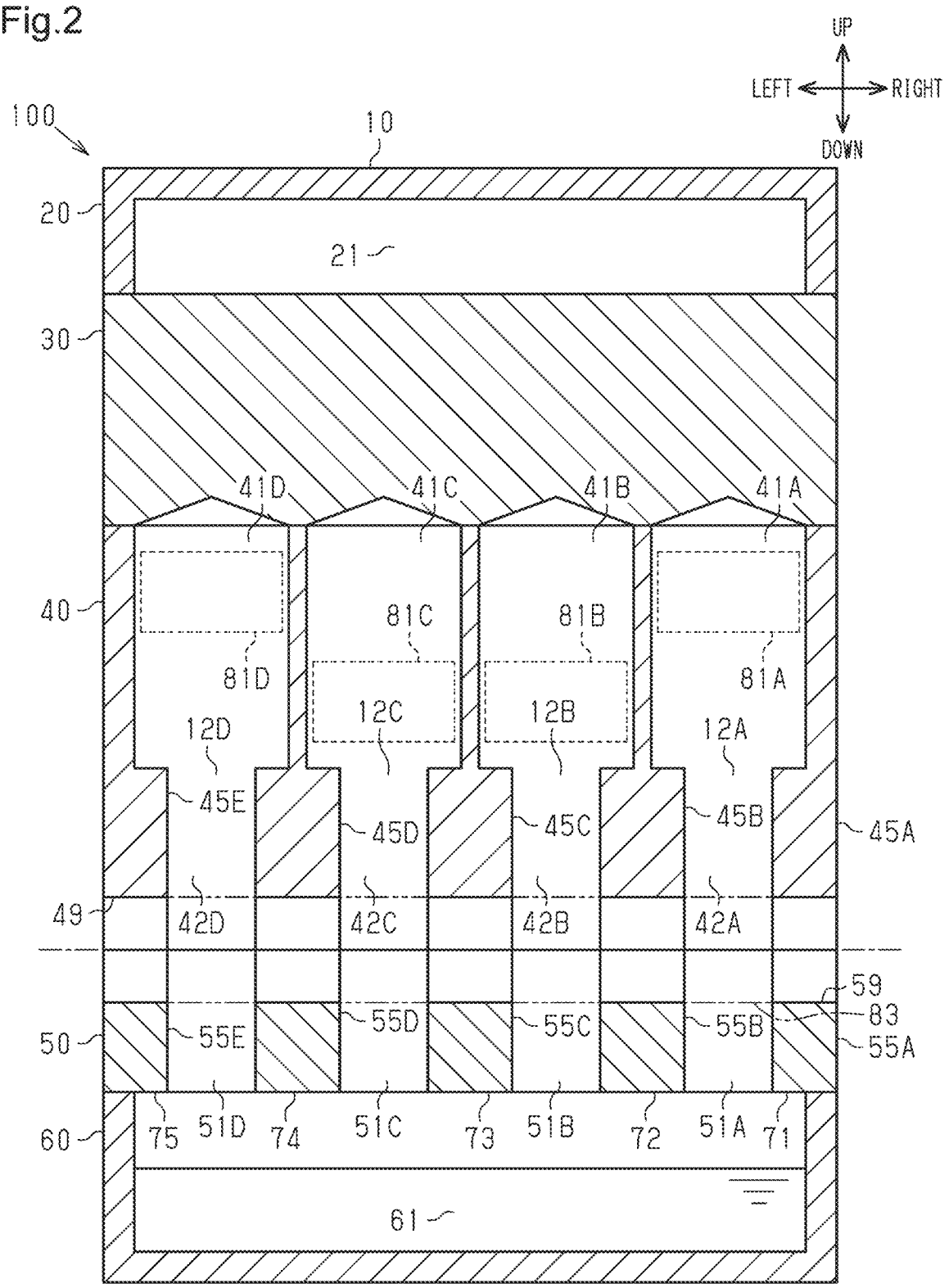
FIG. 2 is a cross-sectional view taken along line 2-2 in FIG. 1.

As illustrated in FIG. 2, the cylinder block 40 includes a first upper wall 45A, a second upper wall 45B, a third upper wall 45C, a fourth upper wall 45D, and a fifth upper wall 45E as walls that define the upper space 42. The first upper wall 45A is a wall that defines the first upper space 42A from the right-hand side. The second upper wall 45B is a wall that separates the first upper space 42A and the second upper space 42B from each other. The third upper wall 45C is a wall that separates the second upper space 42B and the third upper space 42C from each other. The fourth upper wall 45D is a wall that separates the third upper space 42C and the fourth upper space 42D from each other. The fifth upper wall 45E is a wall that defines the fourth upper space 42D from the left-hand side.

The cylinder block 40 includes five upper recesses 49. The upper recesses 49 are recessed upward from the lower surface of the cylinder block 40. The upper recesses 49 are located one by one in the first upper wall 45A to the fifth upper wall 45E. When the internal combustion engine 100 is viewed from the right side, the five upper recesses 49 are located at the same location. When the internal combustion engine 100 is viewed from the right side, the shape of the space defined by the upper recess 49 is a substantially semicircular shape. The inner wall surface of the upper recess 49 supports the crankshaft 83 from the upper side through a bearing (not illustrated). In FIG. 2, the crankshaft 83 is illustrated in a simplified manner.

As illustrated in FIG. 1, the crankcase 50 is connected to the lower end of the cylinder block 40. The structure of the crankcase 50 is a so-called ladder frame structure. Therefore, the crankcase 50 includes four lower spaces 51 as internal spaces. The lower space 51 extends from the upper end to the lower end of the crankcase 50. The dimension of the lower space 51 in the longitudinal direction of the vehicle is substantially the same as the dimension of the upper space 42 in the longitudinal direction of the vehicle. The dimension of the lower space 51 in the lateral direction of the vehicle is substantially the same as the dimension of the upper space 42 in the lateral direction of the vehicle. The lower space 51 is connected to the lower end of the upper space 42. Hereinafter, when collectively describing the four lower spaces 51, they are simply referred to as the lower spaces 51. When describing the four lower spaces 51 in a distinguished manner, they are referred to as a first lower space 51A, a second lower space 51B, a third lower space 51C, and a fourth lower space 51D in order from the right end toward the left direction, as illustrated in FIG. 2.

As illustrated in FIG. 1, in the present embodiment, the upper spaces 42 and the lower spaces 51 form crank chambers 12. As illustrated in FIG. 2, the first upper space 42A and the first lower space 51A form a first crank chamber 12A. The second upper space 42B and the second lower space 51B form a second crank chamber 12B. The third upper space 42C and the third lower space 51C form a third crank chamber 12C. The fourth upper space 42D and the fourth lower space 51D form a fourth crank chamber 12D.

The crankcase 50 includes a first lower wall 55A, a second lower wall 55B, a third lower wall 55C, a fourth lower wall 55D, and a fifth lower wall 55E as walls defining the lower space 51. The first lower wall 55A is a wall that defines the first lower space 51A from the right-hand side. The second lower wall 55B is a wall that separates the first lower space 51A and the second lower space 51B from each other. The third lower wall 55C is a wall that separates the second lower space 51B and the third lower space 51C from each other. The fourth lower wall 55D is a wall that separates the third lower space 51C and the fourth lower space 51D from each other. The fifth lower wall 55E is a wall that defines the fourth lower space 51D from the left-hand side.

In the present embodiment, the first upper wall 45A and the first lower wall 55A are first walls 71 that define the first crank chamber 12A from the right-hand side. The second upper wall 45B and the second lower wall 55B are second walls 72 that separates the first crank chamber 12A and the second crank chamber 12B from each other. The third upper wall 45C and the third lower wall 55C are third walls 73 that separates the second crank chamber 12B and the third crank chamber 12C from each other. The fourth upper wall 45D and the fourth lower wall 55D are fourth walls 74 that separates the third crank chamber 12C and the fourth crank chamber 12D from each other. The fifth upper wall 45E and the fifth lower wall 55E are fifth walls 75 that define the fourth crank chamber 12D from the left-hand side.

The crankcase 50 includes five lower recesses 59 as internal spaces. The lower recess 59 is recessed downward from the upper surface of the crankcase 50. The lower recesses 59 are located one by one in the first lower wall 55A to the fifth lower wall 55E. When the internal combustion engine 100 is viewed from the right side, the five lower recesses 59 are located at the same location. Each of the lower recesses 59 vertically faces the upper recess 49 of the cylinder block 40. When the internal combustion engine 100 is viewed from the right side, the shape of the space defined by the lower recess 59 is a substantially semicircular shape. The inner wall surface of the lower recess 59 supports the crankshaft 83 from the lower side through a bearing (not illustrated).

As illustrated in FIG. 1, the oil pan 60 is connected to the lower end of the crankcase 50. The shape of the oil pan 60 is a substantially quadrangular box shape having a bottom. Therefore, the oil pan 60 includes the oil chamber 61 as an internal space. The dimension of the oil chamber 61 in the longitudinal direction of the vehicle is substantially the same as the dimension of the lower space 51 in the longitudinal direction of the vehicle. The dimension of the oil chamber 61 in the lateral direction of the vehicle is larger than the dimension from the left end of the lower space 51 located at the left end to the right end of the lower space 51 located at the right end. The oil chamber 61 is connected to lower ends of the four lower spaces 51. Therefore, the oil chamber 61 is connected to the side opposite to the cylinder 41 as viewed from the crank chamber 12. The oil chamber 61 can store oil.

The cylinder head 30 is connected to an upper end of the cylinder block 40. The shape of the cylinder head 30 is a quadrangular prism shape as a whole. The cylinder head 30 includes four intake ports 31, four exhaust ports 32, and four combustion recesses 33 as internal spaces. The combustion recesses 33 are recessed upward from the lower surface of the cylinder head 30. The combustion recess 33 is connected to the upper end of the cylinder 41. The combustion recess 33, the cylinder 41, and the piston 81 define a combustion chamber.

A first end of the intake port 31 is connected to the combustion recess 33. A second end of the intake port 31 opens to the front surface of the cylinder head 30. The intake pipe 91 is connected to the front surface of the cylinder head 30. The intake port 31 introduces intake air from the outside of the internal combustion engine 100 into the cylinder 41 through the intake pipe 91. In FIG. 3, the intake port 31 is not illustrated.

As shown in FIG. 1, a first end of the exhaust port 32 is connected to the combustion recess 33. A second end of the exhaust port 32 opens to the rear surface of the cylinder head 30. The exhaust pipe 92 is connected to the rear surface of the cylinder head 30. The exhaust port 32 discharges exhaust gas from the cylinder 41 to the outside of the internal combustion engine 100 through the exhaust pipe 92.

The head cover 20 is connected to the upper end of the cylinder head 30. The shape of the head cover 20 is a substantially quadrangular box shape having a top plate. Therefore, the head cover 20 includes an internal space 21 as internal spaces. The internal space 21 accommodates a valve gear mechanism (not illustrated) and the like.

<Configuration Related to Blow-By Gas Passage>

Figure 3:
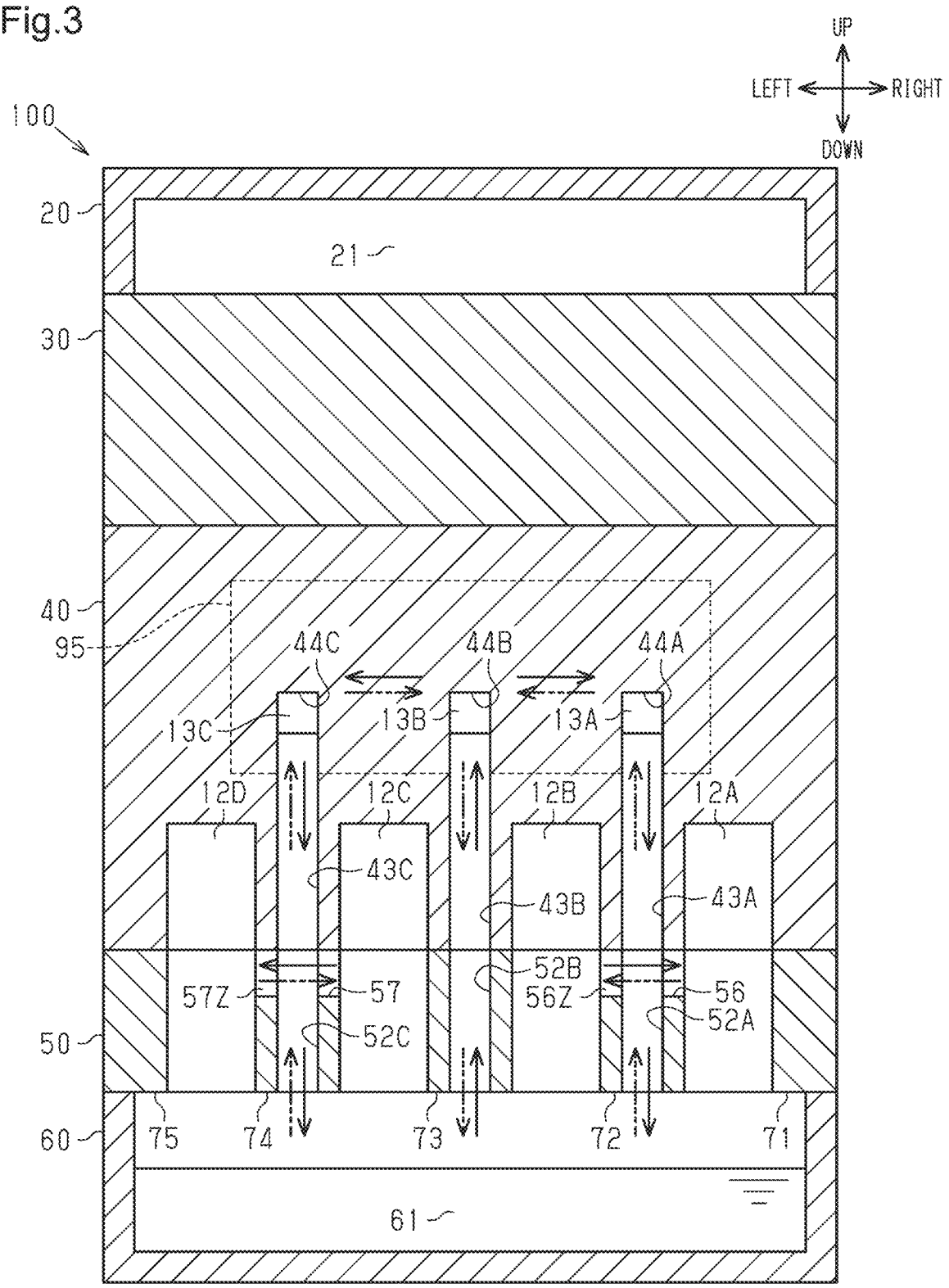
FIG. 3 is a cross-sectional view taken along line 3-3 in FIG. 1.

As illustrated in FIGS. 1 and 3, the crankcase 50 includes three upstream passages 52 as internal spaces. The upstream passage 52 extends from the upper end to the lower end of the crankcase 50. The upstream passage 52 is located on the front side of the lower recess 59. One of the upstream passages 52 is located in the second lower wall 55B. One of the upstream passages 52 is located in the third lower wall 55C. One of the upstream passages 52 is located in the fourth lower wall 55D. When the internal combustion engine 100 is viewed from the right side, the three upstream passages 52 are located at the same location. Hereinafter, when collectively describing the three upstream passages 52, they are simply referred to as the upstream passages 52. When describing the three upstream passages 52 in a distinguished manner, they are referred to as a first upstream passage 52A, a second upstream passage 52B, and a third upstream passage 52C in order from the right end toward the left direction.

The cylinder block 40 includes three midstream passages 43 and three downstream passages 44 as internal spaces. The midstream passage 43 extends from the lower end of the cylinder block 40 to the vicinity of the vertical center of the cylinder block 40. The lower end of the midstream passage 43 is connected to the upper end of the upstream passage 52. One of the midstream passages 43 is located in the second upper wall 45B. One of the midstream passages 43 is located in the third upper wall 45C. One of the midstream passages 43 is located in the fourth upper wall 45D. When the internal combustion engine 100 is viewed from the right side, the three midstream passages 43 are located at the same location. The downstream passage 44 extends from the upper end of the midstream passage 43 to the front surface of the cylinder block 40. Hereinafter, when collectively describing the three midstream passages 43, they are simply referred to as the midstream passages 43. When describing the three midstream passages 43 in a distinguished manner, they are referred to as a first midstream passage 43A, a second midstream passage 43B, and a third midstream passage 43C in order from the right end toward the left direction. Similarly, when collectively describing the three downstream passages 44, they are simply referred to as the downstream passages 44. When describing the three downstream passages 44 in a distinguished manner, they are referred to as a first downstream passage 44A, a second downstream passage 44B, and a third downstream passage 44C in order from the right end toward the left direction.

In the present embodiment, the upstream passage 52, the midstream passage 43, and the downstream passage 44 constitute a blow-by gas passage 13. Therefore, the first upstream passage 52A, the first midstream passage 43A, and the first downstream passage 44A are the first blow-by gas passages 13A. The second upstream passage 52B, the second midstream passage 43B, and the second downstream passage 44B are second blow-by gas passages 13B. The third upstream passage 52C, the third midstream passage 43C, and the third downstream passage 44C are third blow-by gas passages 13C.

The internal combustion engine 100 includes an oil separator 95. The oil separator 95 is fixed to the front surface of the cylinder block 40. The oil separator 95 can separate oil contained in the gas introduced into the oil separator 95. The oil separator 95 is connected to the downstream passage 44 of the cylinder block 40. Therefore, the oil separator 95 can introduce the gas in the oil chamber 61 through the blow-by gas passage 13. The gas from which the oil is separated in the oil separator 95 flows into the internal space 21 of the head cover 20 through a connection passage (not illustrated). In FIG. 1, the oil separator 95 is illustrated in a simplified manner.

As illustrated in FIG. 3, the crankcase 50 includes a first recess 56 and a second recess 57 as internal spaces. The first recess 56 is recessed downward from the upper surface of the crankcase 50. The first recess 56 is located on the front side of the lower recess 59. The first recess 56 is located in the second lower wall 55B of the second wall 72. The first recess 56 extends from the first crank chamber 12A to the second crank chamber 12B. Therefore, the space defined by the first recess 56 is a first connecting path 56Z connecting the first crank chamber 12A and the second crank chamber 12B. The first connecting path 56Z is also connected to the first blow-by gas passage 13A. In the present embodiment, the upper surface of the crankcase 50 is a connection surface of the cylinder block 40 and the crankcase 50.

The second recess 57 is recessed downward from the upper surface of the crankcase 50. The second recess 57 is located on the front side of the lower recess 59. The second recess 57 is located in the fourth lower wall 55D of the fourth wall 74. The second recess 57 extends from the third crank chamber 12C to the fourth crank chamber 12D. Therefore, the space defined by the second recess 57 is a second connecting path 57Z connecting the third crank chamber 12C and the fourth crank chamber 12D to each other. The second connecting path 57Z is also connected to the third blow-by gas passage 13C.

In the present embodiment, when the internal combustion engine 100 is from the right side, the first connecting path 56Z and the second connecting path 57Z are located at the same location. The third wall 73 does not have a passage connecting the second crank chamber 12B and the third crank chamber 12C.

Operation of Present Embodiment

Assume that the second cylinder 41B is in the combustion stroke during the driving of the internal combustion engine 100. At this time, the second piston 81B and the third piston 81C move downward so as to approach the oil chamber 61. In the case of such movement, the pressure of the gas in the vicinity of the third wall 73 in the oil chamber 61 increases. Then, as indicated by the arrows of solid lines in FIG. 3, the gas in the vicinity of the third wall 73 in the oil chamber 61 flows into the oil separator 95 through the second blow-by gas passage 13B. As a result, the pressure inside the oil separator 95 increases. Then, the gas inside the oil separator 95 flows to the first crank chamber 12A and the vicinity of the second wall 72 of the oil chamber 61 through the first blow-by gas passage 13A. Similarly, the gas inside the oil separator 95 flows to the fourth crank chamber 12D and the vicinity of the fourth wall 74 of the oil chamber 61 through the third blow-by gas passage 13C.

Assume that the second cylinder 41B is in the exhaust stroke during the driving of the internal combustion engine 100. At this time, the second piston 81B and the third piston 81C move upward so as to separate away from the oil chamber 61. In the case of such movement, the pressure of the gas in the vicinity of the third wall 73 in the oil chamber 61 decreases. Then, as indicated by the arrows of long-dash double-short-dash lines in FIG. 3, the gas inside the oil separator 95 flows to the vicinity of the third wall 73 in the oil chamber 61 through the second blow-by gas passage 13B. As a result, the pressure inside the oil separator 95 decreases. Then, the gas in the first crank chamber 12A and the gas in the vicinity of the second wall 72 in the oil chamber 61 flow into the oil separator 95 through the first blow-by gas passage 13A. Similarly, the gas in the fourth crank chamber 12D and the gas in the vicinity of the fourth wall 74 in the oil chamber 61 flow into the oil separator 95 through the third blow-by gas passage 13C.

As described above, in the internal combustion engine 100, a set of the first piston 81A and the second piston 81B and a set of the third piston 81C and the fourth piston 81D reciprocate symmetrically with the third wall 73 as a boundary. Then, symmetrical air flows are generated in the space on the left side of the third wall 73 and the space on the right side of the third wall 73.

Advantages of Present Embodiment (1) Assume that the third wall 73 has a passage connecting the second crank chamber 12B and the third crank chamber 12C. In this case, the gas can move between the second crank chamber 12B and the third crank chamber 12C through the passage. On the other hand, the second piston 81B and the third piston 81C reciprocate in the same phase. Therefore, ideally, the gas flow in the second crank chamber 12B and the gas flow in the third crank chamber 12C are the same. As a result, even if the third wall 73 has a passage connecting the second crank chamber 12B and the third crank chamber 12C, a large amount of gas does not flow through the passage. However, in practice, the gas may flow into the passage of the third wall 73 due to a slight difference between the gas flow in the second crank chamber 12B and the gas flow in the third crank chamber 12C. Then, due to the movement of the gas through the passage of the third wall 73, there is a possibility that a symmetrical air flow between the space on the left side of the third wall 73 and the space on the right side of the third wall 73 is not generated. When the symmetry of the gas flow is disturbed in this manner, it is not guaranteed that the gas will flow through each blow-by gas passage 13 as designed.

In this regard, in the present embodiment, the third wall 73 does not have a passage connecting the second crank chamber 12B and the third crank chamber 12C. Therefore, the gas does not move between the second crank chamber 12B and the third crank chamber 12C through the passage of the third wall 73. As a result, a symmetrical air flow is more reliably generated between the space on the left side of the third wall 73 and the space on the right side of the third wall 73. As a result, it is possible to suppress the occurrence of turbulent flow in the space inside the engine body 10. If the occurrence of turbulent flow can be suppressed in this manner, an excessive amount of oil can be prevented from flowing into the oil separator 95 due to an increase in the amount of oil contained in the gas. The oil contained in the gas can be appropriately separated in the oil separator 95.

(2) In the present embodiment, the first connecting path 56Z is also connected to the first blow-by gas passage 13A. In the internal combustion engine 100, the first piston 81A and the second piston 81B reciprocate in opposite phases. Therefore, for example, when the second cylinder 41B is in the combustion stroke, the gas flows from the second crank chamber 12B to the first crank chamber 12A through the first connecting path 56Z as indicated by the arrows of solid lines in FIG. 3. On the other hand, for example, when the second cylinder 41B is in the exhaust stroke, the gas flows from the first crank chamber 12A to the second crank chamber 12B through the first connecting path 56Z as indicated by the arrows of long-dash double-short-dash lines in FIG. 3. In this manner, a regular gas flow according to the cycle of the reciprocating motion of the first piston 81A and the second piston 81B is generated in the first connecting path 56Z. That is, a turbulent flow unintended in design is less likely to occur in the first connecting path 56Z. As a result, even when the first connecting path 56Z is connected to the first blow-by gas passage 13A, it is possible to suppress the generation of the turbulent flow in the first blow-by gas passage 13A due to the turbulent flow generated in the first connecting path 56Z. Rather, the gas can be actively circulated in the first blow-by gas passage 13A by utilizing the flow of gas in the first crank chamber 12A and the second crank chamber 12B. Although details are omitted, the same applies to the second connecting path 57Z.

(3) In the present embodiment, when the internal combustion engine 100 is viewed from the right side, the first connecting path 56Z and the second connecting path 57Z are located at the same location. Therefore, the flow of gas tends to be more symmetrical between the space on the left side of the third wall 73 and the space on the right side of the third wall 73. As the flow of gas in the two spaces are more symmetrical in this manner, unintended turbulent flow is prevented from occurring inside the engine body 10.

(4) In the present embodiment, the space defined by the first recess 56 functions as the first connecting path 56Z, and the space defined by the second recess 57 functions as the second connecting path 57Z. As a result, the first connecting path 56Z can be realized with a simple structure as compared with a case in which a space defined by two recesses of the recess of the cylinder block 40 and the recess of the crankcase 50 functions as the first connecting path 56Z. The same applies to the second connecting path 57Z.

(5) In general, the structure of the cylinder block 40 tends to be more complicated than the structure of the crankcase 50. In this regard, in the present embodiment, the crankcase 50 includes the first recess 56 and the second recess 57. As a result, it is not necessary to adopt a structure for realizing the first connecting path 56Z and the second connecting path 57Z in the cylinder block 40 having a relatively complicated structure. Therefore, the structure of the cylinder block 40 can be prevented from being further complicated due to the first recess 56 and the second recess 57.

Modifications

The present embodiment can be modified and implemented as follows. The present embodiment and the following modifications can be implemented in combination with each other within a scope not technically contradicting each other.

In the above embodiment, the order in which the four cylinders 41 reach the combustion stroke may be changed. For example, the internal combustion engine 100 may be configured such that when the first cylinder 41A reaches the combustion stroke, the second cylinder 41B reaches the compression stroke, the fourth cylinder 41D reaches the intake stroke, and the third cylinder 41C reaches the exhaust stroke. That is, in the internal combustion engine 100, when the second piston 81B and the third piston 81C reciprocate in the opposite phase to the first piston 81A, and the fourth piston 81D reciprocate in the same phase as the first piston 81A, the order in which the four cylinders 41 reach the combustion stroke can be changed.

In the above embodiment, the shapes of the first connecting path 56Z and the second connecting path 57Z may be changed. For example, the first connecting path 56Z may bypass the first blow-by gas passage 13A and connect the first crank chamber 12A and the second crank chamber 12B. Similarly, the second connecting path 57Z may bypass the third blow-by gas passage 13C and connect the third crank chamber 12C and the fourth crank chamber 12D.

In the above embodiment, the positions of the first connecting path 56Z and the second connecting path 57Z may be changed. For example, the first connecting path 56Z may be located in front of the second connecting path 57Z, or may be located behind the second connecting path 57Z. Furthermore, for example, the first connecting path 56Z may be located above the second connecting path 57Z or may be located below the second connecting path 57Z. That is, when the internal combustion engine 100 is viewed in the leftward direction, the first connecting path 56Z and the second connecting path 57Z may not be located at the same location. The first connecting path 56Z and the second connecting path 57Z may be located inside the crankcase 50 without being open to the upper surface of the crankcase 50. That is, the first connecting path 56Z may be a through-hole extending the second lower wall 55B of the crankcase 50. Similarly, the second connecting path 57Z may be a through-hole extending through the fourth lower wall 55D of the crankcase 50.

In the above embodiment, the members constituting the first connecting path 56Z and the second connecting path 57Z may be changed. For example, the first connecting path 56Z may be a space defined by the first recess 56 of the crankcase 50 and the recess of the cylinder block 40. Furthermore, for example, the first connecting path 56Z may be a space defined only by the recess of the cylinder block 40. Further, for example, when the first connecting path 56Z is defined only in the cylinder block 40, the first connecting path 56Z may be located inside the cylinder block 40 without being open to the lower surface of the cylinder block 40. That is, the first connecting path 56Z may be a through-hole extending through the second upper wall 45B of the cylinder block 40. Similarly, the members constituting the second connecting path 57Z can be changed.

In the above embodiment, a so-called crank cap may be adopted instead of the crankcase 50. In this case, the crank cap functions as the first lower wall 55A to the fifth lower wall 55E.

In the above embodiment, the internal combustion engine 100 is not limited to an in-line four-cylinder engine, and may be, for example, a V-type eight-cylinder engine. That is, the present technology can be applied to the internal combustion engine 100 in which the four cylinders 41 are arranged along the axis of the crankshaft 83.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. An internal combustion engine, comprising:

a first cylinder, a second cylinder, a third cylinder, and a fourth cylinder which are cylinders arranged in order in a first direction along an axis of a crankshaft;

a first crank chamber connected to the first cylinder, a second crank chamber connected to the second cylinder, a third crank chamber connected to the third cylinder, and a fourth crank chamber connected to the fourth cylinder;

an oil chamber that is connected to the first crank chamber, the second crank chamber, the third crank chamber, and the fourth crank chamber on a side opposite to the cylinders, the oil chamber storing oil;

a first piston reciprocating in the first cylinder, a second piston reciprocating in the second cylinder in an opposite phase to the first piston, a third piston reciprocating in the third cylinder in the opposite phase to the first piston, and a fourth piston reciprocating in the fourth cylinder in a same phase as the first piston;

a first wall that defines the first crank chamber from a side in a second direction opposite to the first direction, a second wall that separates the first crank chamber and the second crank chamber from each other, a third wall that separates the second crank chamber and the third crank chamber from each other, a fourth wall that separates the third crank chamber and the fourth crank chamber from each other, and a fifth wall that defines the fourth crank chamber from a side in the first direction;

a first blow-by gas passage defined in the second wall and connecting the oil chamber and an oil separator, a second blow-by gas passage defined in the third wall and connecting the oil chamber and the oil separator, and a third blow-by gas passage defined in the fourth wall and connecting the oil chamber and the oil separator; and a first connecting path defined in the second wall and connecting the first crank chamber and the second crank chamber to each other, and a second connecting path defined in the fourth wall and connecting the third crank chamber and the fourth crank chamber to each other, wherein the third wall has no passage connecting the second crank chamber and the third crank chamber to each other, and a set of the first piston and the second piston and a set of the third piston and the fourth piston reciprocate symmetrically with the third wall as a boundary.

2. The internal combustion engine according to claim 1, wherein the first connecting path is connected to the first blow-by gas passage, and the second connecting path is connected to the third blow-by gas passage.

3. The internal combustion engine according to claim 1, wherein the first connecting path and the second connecting path are located at the same location when viewed in the first direction.

4. The internal combustion engine according to claim 1, further comprising:

a cylinder block that defines the first cylinder, the second cylinder, the third cylinder, and the fourth cylinder, a crankcase that is connected to the cylinder block and defines the first crank chamber, the second crank chamber, the third crank chamber, and the fourth crank chamber, and an oil pan that is connected to the crankcase and defines the oil chamber, wherein one of the cylinder block and the crankcase includes first and second recesses recessed in a connection surface between the cylinder block and the crankcase, a space defined by the first recess is the first connecting path, and a space defined by the second recess is the second connecting path.

5. The internal combustion engine according to claim 4, wherein the crankcase includes the first recess and the second recess.

6. The internal combustion engine according to claim 5, wherein the first recess and the second recess are recessed downward from an upper surface of the crankcase, the upper surface defining the connection surface.

7. The internal combustion engine according to claim 4, wherein each of the first, second, and third blow-by gas passages comprises:

an upstream passage in the crankcase, the upstream passage extending from an upper end to a lower end of the crankcase, and a midstream passage and a downstream passage in the cylinder block, the midstream passage is connected to an upper end of the upstream passage and extends from a lower end of the cylinder block to a vicinity of a vertical center of the cylinder block, and the downstream passage extends from an upper end of the midstream passage to the oil separator, which is fixed to a front surface of the cylinder block.

8. The internal combustion engine according to claim 6, wherein each of the first, second, and third blow-by gas passages comprises:

an upstream passage in the crankcase, the upstream passage extending from an upper end to a lower end of the crankcase, and a midstream passage and a downstream passage in the cylinder block, the midstream passage is connected to an upper end of the upstream passage and extends from a lower end of the cylinder block to a vicinity of a vertical center of the cylinder block, and the downstream passage extends from an upper end of the midstream passage to the oil separator, which is fixed to a front surface of the cylinder block.

9. The internal combustion engine according to claim 8, wherein the first connecting path is connected to the first blow-by gas passage, and the second connecting path is connected to the third blow-by gas passage.

10. The internal combustion engine according to claim 9, wherein the first connecting path and the second connecting path are located at the same location when viewed in the first direction.

* * * * *